US006729251B2

(12) United States Patent
Nishikawa et al.

(10) Patent No.: US 6,729,251 B2
(45) Date of Patent: May 4, 2004

(54) REGULATING DEVICE FOR HANDLING A NEEDLE THREAD IN A MULTI-NEEDLE DOUBLE CHAIN STITCH SEWING MACHINE

(75) Inventors: Masahiko Nishikawa, Osaka (JP); Osamu Doyasu, Osaka (JP); Hiroyuki Iuchi, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/209,715

(22) Filed: Jul. 31, 2002

(65) Prior Publication Data

US 2003/0024451 A1 Feb. 6, 2003

(30) Foreign Application Priority Data

Aug. 2, 2001 (JP) ..... 2001-234367

(51) Int. Cl.[7] ..... D05B 49/00
(52) U.S. Cl. ..... 112/245
(58) Field of Search ..... 112/167, 241, 112/165, 242, 243, 245, 246

(56) References Cited

U.S. PATENT DOCUMENTS 1,166,037 A * 12/1915 Barron ..... 112/245
2,173,320 A * 9/1939 De Voe ..... 267/52
4,320,712 A * 3/1982 Johnson ..... 112/184
4,444,138 A * 4/1984 Yamazawa ..... 112/241
5,513,587 A 5/1996 Takada et al.
6,390,000 B1 5/2002 Nishikawa

FOREIGN PATENT DOCUMENTS

EP 1184503 * 3/2002
JP 57-14197 3/1982
JP 29-74557 9/1999

* cited by examiner

*Primary Examiner*—Ismael Izaguirre
(74) *Attorney, Agent, or Firm*—Flynn, Thiel, Boutell & Tanis, P.C.

(57) ABSTRACT

A thread taking-up tool is attached to a needle bar sticking out of a sewing machine head, and its leading end has a plurality of thread holes. The thread holes of the thread taking-up tool are arranged in the lateral direction. A thread handling body has a cam face in the vertical direction. Needle threads from a tension device to needles are controlled by the vertical motion of the thread taking-up tool and the action of the cam face of the thread handling body. When the needles ascend from the lowest position, an endless hook attached to the thread taking-up tool is engaged with the left needle thread between the cam face lower end and the thread hole of the thread taking-up tool. Each thread is handled in with the left needle thread staying at the cam face lower end, so that the needle thread loop at the remotest end is absorbed surely.

6 Claims, 5 Drawing Sheets

REGULATING DEVICE FOR HANDLING A NEEDLE THREAD IN A MULTI-NEEDLE DOUBLE CHAIN STITCH SEWING MACHINE

BACKGROUND OF THE INVENTION

The present invention relates to a regulating device for handling a needle thread from a tension device to a needle to loosen a thread and to absorb looseness of a thread in a multi-needle double chain stitch sewing machine. In the present invention, the needle thread is arranged in plural sets corresponding to the needles.

Japanese Patent No. 2974557 discloses this kind of regulating device, in which said needle thread is controlled by the vertical motion of the needle bar take-up, and cam face action of the thread handling plate, so as to loosen the thread or absorb thread looseness. This regulating device comprises a needle bar take-up and a thread handling plate. The needle bar take-up is supported by a needle bar, and moves up and down together with the needle bar. The needle bar take-up is stuck out of a through-hole opened in the sewing machine head. The thread handling plate is disposed at the front side of the sewing machine head near the through-hole, and has a cam face extending in the vertical direction. The tension device has plural thread tensioners.

In this regulating device, the cam face of the thread handling plate comprises a cam face portion for the left needle thread and a cam face portion for the right needle thread, with the respective cam face portions formed before and after the thread handling plate. Each cam face portion is designed to absorb the needle thread loop that is formed when the needle is slightly lifted from the lowest position. Consequently, the looper picks up and tightens the needle thread.

In the multi-needle double chain stitch sewing machine, as shown in FIG. 4, needles 8 are arranged in the lateral direction, and the looper 7 moves in the lateral direction to sequentially pick up the needle thread loop 8L of each needle 8 from the right side. In order to match the timing of each needle 8 with the looper 7, the height of the needle hole is set gradually lower on the left side of the needle. Therefore, for the leftmost side of the needle, the needle ascending distance from the lowest position is the longest at a pick-up position of the needle thread loop by the looper. Consequently, the needle thread loop that is formed as the cloth is handled during the ascending motion of the needle is also large. If the needle thread loop is too large, the needle thread loop may collapse, and the looper may fail to pick up the needle thread loop.

In the regulating device disclosed in Japanese Patent No. 2974557, as shown in FIG. 5, during the ascending motion of the needle bar take-up, the left needle thread t slides along the cam face c in the direction of the arrow to reach point a (this point is right after the looper picks up the needle thread loop). In this manner, the regulating device is designed to absorb the looseness of the needle thread loop by the cam face c. However, since the gradient and rise L of the cam face c are large, it is difficult to slide the needle thread t smoothly along the cam face c.

In this regulating device, the needle bar take-up sticks out of the front side of the sewing machine head. The needle thread is passed through a plurality of eyelets that are formed at the leading end of the needle bar take-up and which are arranged in the longitudinal direction, while the cam faces are formed side by side before and after the needle handling plate. Accordingly, the extent of the needle bar take-up and thread handling plate that sticks out of the sewing machine head front side toward the operator is increased, thereby creating a threatening pressure to the operator. Additionally, a plurality of cam faces are formed in the thread handling plate, resulting in an even more complicated structure. Moreover there are lubricating points on the bearing that supports the needle bar and the upper shaft, along with other lubricating points in the sewing machine head, and during vertical motion of the needle bar or rotation of the upper shaft, the lubricating oil may splash outside through the through-hole in which the needle bar take-up sticks out.

SUMMARY OF THE INVENTION

It is hence an object of the invention to present a regulating device for handling a needle thread in a multi-needle double chain stitch sewing machine capable of moving the needle threads smoothly by minimizing the rise of the cam face engaged with the needle thread, from the time of the needles ascending via the lowest position until the threads is tightened right after the looper picks up the needle thread loops. It is other object to present a regulating device for handling a needle thread in a multi-needle double chain stitch sewing machine simplified in structure by forming only one cam face in the thread handling body, lessened in the threatening pressure by reducing the stuck amount of the thread handling body and thread taking-up tool to the operator, and free from splash of oil to outside of the sewing machine.

The present invention comprises a thread taking-up tool and a thread handling body. The thread taking-up tool is attached to the needle bar, and moves vertically together with the needle bar, and a plurality of thread holes are formed at its leading end. The thread handling body is attached to the front side of the sewing machine head near the thread taking-up tool, and has a cam face extending in the vertical direction. Loosening of needle thread and absorption of its looseness from the tension device to the needle are executed by the vertical motion of the thread taking-up tool and the cam face action of the thread handling body.

It is a first feature of the present invention that thread hooking means is provided in the thread taking-up tool. The thread hooking means is engaged with the needle thread supplied to the remotest needle where a largest needle thread loop is formed, among the needles arranged in the lateral direction. The thread engagement of the hooking means is continued until the looper picks up the needle thread loops as the needle ascends from the lowest position between the thread holes of the thread taking-up tool and the cam face of the thread handling body. By engagement of the thread hooking means, other needle thread is took up with the remotest end needle thread staying at the curved lower end of the cam face.

According to the present invention, looseness of the needle thread loop in the needle at the remotest end where a largest needle thread loop is formed is absorbed by ascending the thread hooking means and the thread taking-up tool with the needle thread staying at the lower end of the cam face. In other words, looseness of this thread loop is absorbed as the needle thread from the lower end of the cam face to the needle is lifted by the thread taking-up tool and the thread hooking means. Moreover, until the looper picks up the needle thread loops, said needle thread remains at the lower end of the cam face. That is, until the looper picks up the needle thread loops to tighten the thread, said needle thread does not slide on the cam face, and cam action is not effected, and hence, the cam face is shorter, the cam rise is smaller, and sliding of needle threads on the cam face is smaller, so that sliding on the cam face is smoother.

The thread hooking means used in the present invention is structured so as to take up other needle thread while the left needle thread is remaining at the cam face lower end until the looper picks up the needle thread loops, and to carry out the handling action of the needle thread. An example is shown as an endless hook in a preferred embodiment below.

It is also a feature of the present invention that the thread taking-up tool is attached to a portion of the needle bar sticking out from the sewing machine head, and that the plurality of thread holes at the leading end of the thread taking-up tool are arranged in the lateral direction.

According to the invention having such structure, by attaching the thread taking-up tool to the needle bar outside of the sewing machine head, it is not necessary to form a through-hole for the thread taking-up tool in the sewing machine head. Accordingly, oil does not splash out from the through-hole formed in the conventional sewing machine head for allowing the thread taking-up tool to stick. Moreover, since the thread holes are formed in the lateral direction, as compared with those formed in the longitudinal direction, the stuck extent of the thread taking-up tool from the sewing machine head to the operator side is smaller.

In a preferred aspect of the invention, the thread taking-up tool is provided at the needle bar sticking out from a position obliquely drawn back in the lower part of the sewing machine head.

Since the lower part of the sewing machine head is usually in a obliquely drawn back shape, when the thread taking-up tool is provided at the needle bar sticking out from the sewing machine head, the thread taking-up tool is also drawn back, being close to the slope drawn back in the lower part of the sewing machine head. As a result, as compared with the structure of sticking out of the front side from the through-hole of the sewing machine head, the stuck extent to the operator is smaller, and the threatening pressure to the operator can be lessened.

In another preferred aspect of the invention, one cam face is formed on the thread handling body, and a plurality of needle threads are engaged with the one cam face.

According to the invention having such structure, since only one cam face is enough, the structure of the thread handling body is simple, and the stuck extent of the thread handling body is smaller.

In a further preferred aspect of the invention, the preferred or other preferred aspect of the invention is combined with the first aspect of the invention. As a result, effects by combinations of aspects of the invention are brought about.

DETAILED DESCRIPTION

Figure 1:
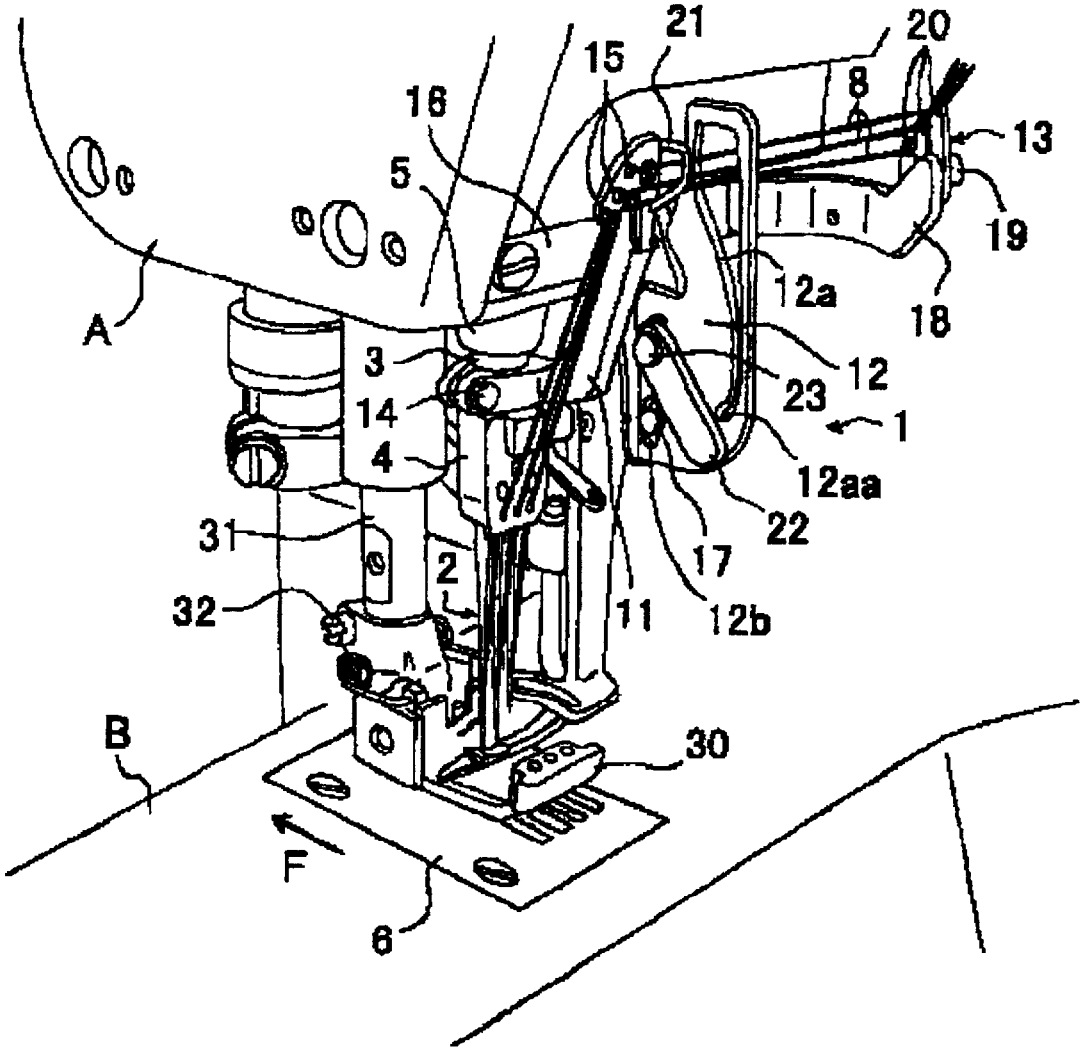
FIG. 1 is a perspective view of a regulating device for handling a needle thread in a multi-needle double chain stitch sewing machine according to the present invention, showing a state of the needles at the highest position.

FIG. 1 shows a regulating device 1 for handling a needle thread in a multi-needle double chain stitch sewing machine. This regulating device 1 is disposed on a thread route of needle thread from a tension device (not shown) fixed on the sewing machine arm to three needles 2. The three needles 2 are disposed at the lower end of a needle bar 3 through a needle holder 4, and the arrangement of said needles is in the lateral direction orthogonal to the cloth feed direction F. Each of the needles 2 has, respectively, a needle hole 9 (FIG. 4) through which the needle thread 8 passes, with each of the needle holes 9 extending higher up as one proceeds to the right along the row of needles. The needle bar 3 is slidably supported by a bush 5 press-fitted into the sewing machine head A at the leading end of the sewing machine arm, and moves reciprocally up and down in collaboration with the rotation of the main shaft of the sewing machine. By reciprocal motion of the needle bar 3, the needles 2 penetrate through the needle holes in a throat plate 6 fixed to the upper side of the sewing machine bed B.

Figure 4:
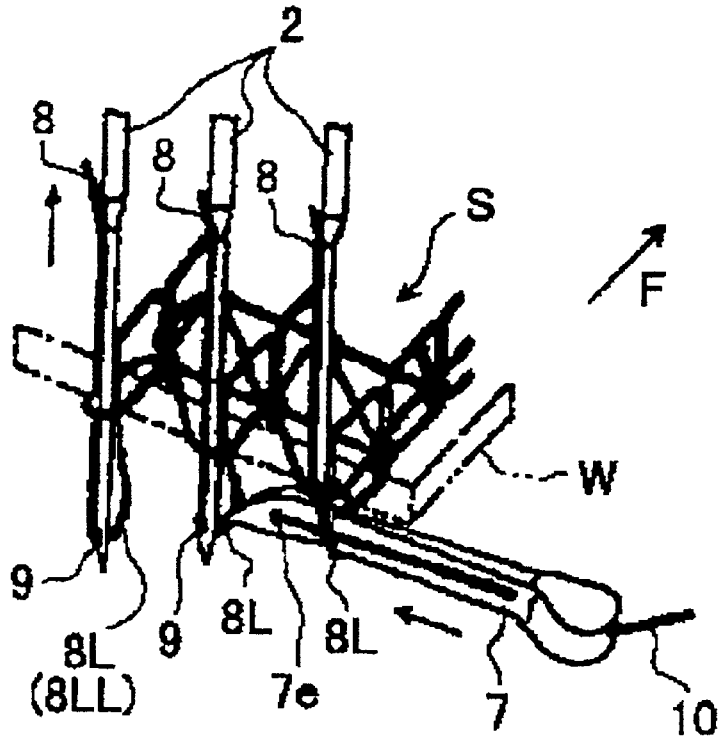
FIG. 4 is a perspective view showing an outline of a multi-needle double chain stitch formation.
Figure 5:
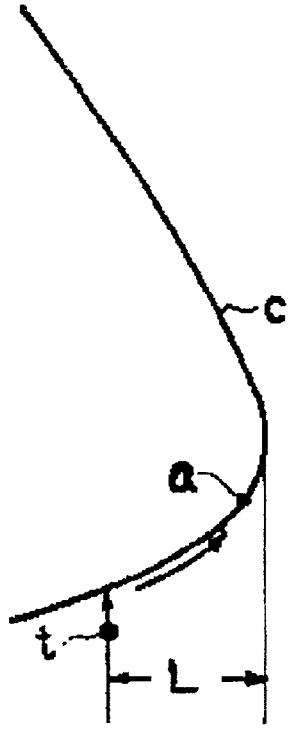
FIG. 5 is a diagram showing a cam face in a conventional regulating device for handling a needle thread.

Disposed beneath the throat plate 6, as shown in FIG. 4, is a looper 7. The looper 7 moves in an elliptical profile in a direction that intersects a cloth feed direction F by collaboration with the rotation of the main shaft of the sewing machine. The leading end of looper 7 is provided with an eyelet 7*e* for inserting a looper thread 10. Through collaboration of the needles 2, which have the needle thread 8 passing through the needle hole 9, and the looper 7, which has the looper thread 10 passing through the eyelet 7*e*, as shown in FIG. 4, a double chain stitch S is formed in a cloth W on the throat plate 6. A presser foot 30 disposed above the throat plate 6 is attached to the lower end of a presser bar 31 by a screw 32, and the presser bar 31 presses the presser foot 30 to the throat plate 6 by a spring (not shown) disposed inside of the sewing machine head A.

This regulating device 1 comprises a thread taking-up tool 11, a thread handling body 12, and a needle thread handling area 13. The thread taking-up tool 11 is fixed to the needle bar 3 sticking down beneath the sewing machine head A near the needle holder 4 (needle mounting area) by a screw 14. Three thread holes 15 are formed at the leading end of the thread taking-up tool 11. Each successive thread hole 15 is positioned higher than the previous thread hole 15 as they progress sidewardly toward the thread handling body 12. The thread taking-up tool 11 is provided with an endless hook 21 as a thread hooking means. The endless hook 21 sticks forward, and three needle threads 8 are inserted together in the inner space of the endless hook 21.

The thread handling body 12 is fixed to the drooping portion of an L-shaped bracket 16 by a screw 17 through a slot 12*b*, the L-shaped bracket 16 being fixed on the sewing machine head A. The vertical position of the thread handling body 12 is adjustable within a range of the slot 12*b*, and its location is near the thread taking-up tool 11. At the front side of the thread handling body 12, a cam face 12*a* is formed, which extends in the vertical direction and is curved in a convex profile toward the front side. The needle thread handling area 13 is composed of three needle thread guide plates, and each needle thread guide plate is attached to a bracket 18 by a screw 19 through a slot (not shown). The bracket 18 is fixed on the sewing machine head A at the leading end of the sewing machine arm. The vertical position of each needle thread guide plate is adjustable within a range of the slot. Each needle thread guide plate has a thread hole 20 for guiding the needle thread.

The thread handling body 12 is also provided with a defining member 22 secured by a screw 23 through a slot. The defining member 22 is adjustable in both a vertical and an inclined position within a range of the slot through loosening of the screw 23. By using the defining member 22, the slide guide range of each needle thread 8 in the cam face 12*a* can be defined. In the rear part of the thread handling body 12, a cam face 12*c* is formed to extend in the vertical direction. The cam face 12*c* is formed for flexible woolly thread. That is, when the needle bar 3 reaches the lowest position, each needle thread can be sufficiently stretched in the horizontal portion 12*d* of the cam face 12*c*.

Figure 2:
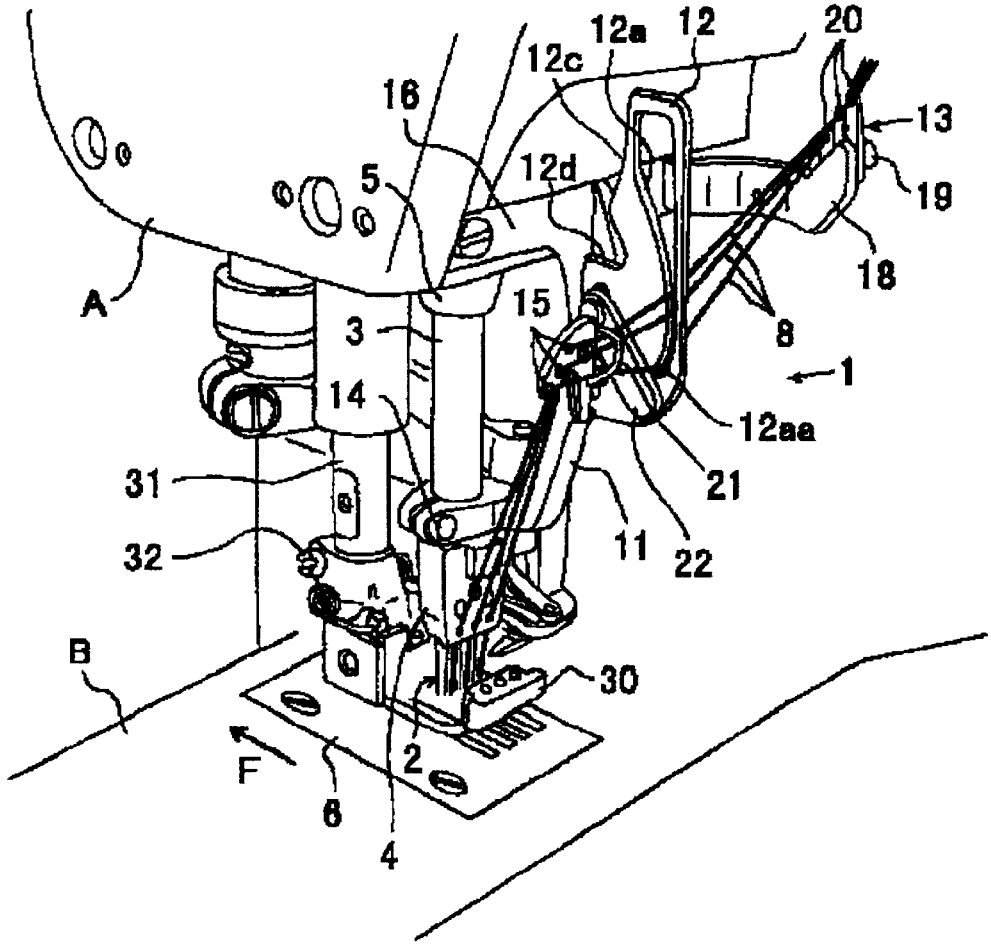
FIG. 2 is a perspective view showing a state of the needles at the lowest position.
Figure 3:
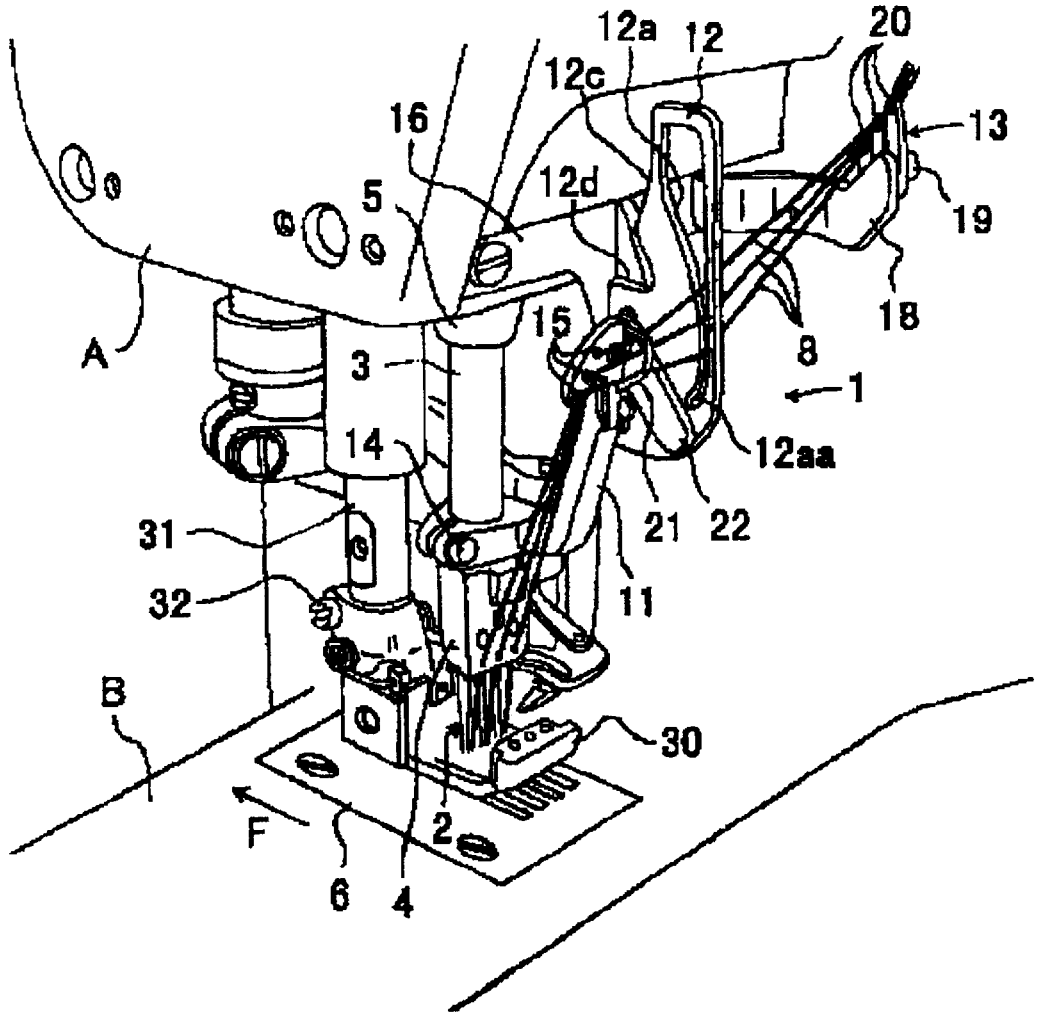
FIG. 3 is a perspective view showing a state of thread tightening as the looper picks up the needle thread loops.

Operation of a regulating device in accordance with the present invention will now be explained in reference to FIGS. 1–3.

As shown in FIG. 1, when the needle bar 3 is at the highest position, the needle threads extend almost horizontally from the thread holes 20 in the needle thread handling area 13 to the thread holes 15 in the thread taking-up tool 11. When the needle taking-up tool 11 descends together with the needle bar 3, the needle threads 8 from the thread holes 20 in the needle thread handling area 13 to the thread holes 15 in the thread taking-up tool 11 are guided to slide along the cam face 12*a* of the thread handling body 12. When the needle bar 3 reaches the lowest position, as shown in FIG. 2, only the left needle thread drops into the arresting portion 12*aa* of the cam face 12*a*.

Figure 6:
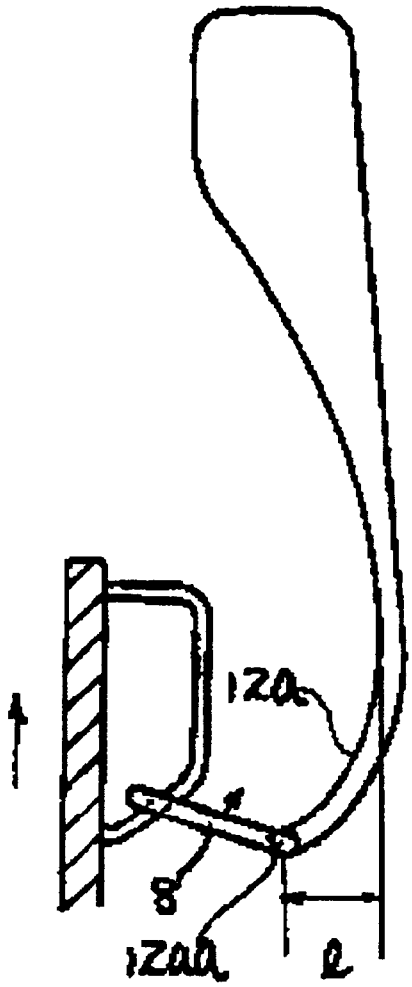
FIG. 6 is a diagram showing a cam face of a thread handling body according to the invention.

When the needle bar 3 reaches the lowest position and begins to ascend, the left needle thread 8 initially rotates clockwise, as shown in FIG. 6, in the direction of the arrow, starting from the arresting portion 12*aa* due to ascent of the endless hook 21. When the endless hook 21 further continues to go up until the left needle thread 8 is raised, the left needle thread is released from the arresting portion 12*aa*, and slides along cam face 12*a* (except for the left needle thread, the middle needle thread and right needle thread slide along the cam face 12*a* as the needle bar 3 ascends from the lowest position).

Figure 7:
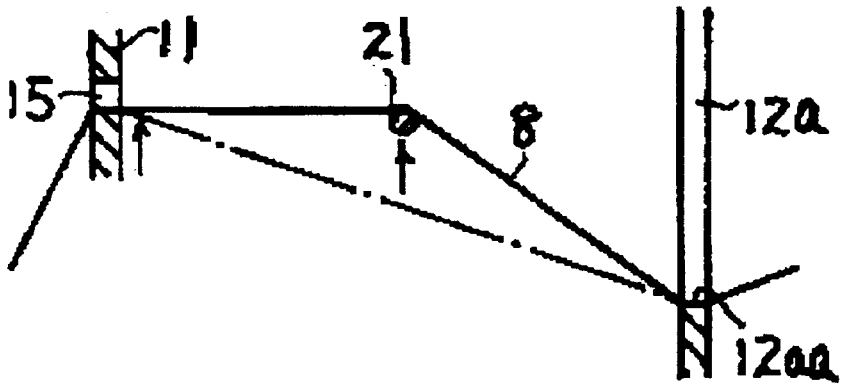
FIG. 7 is a diagram showing a state of the left needle thread being taken up by the thread taking-up tool and endless hook when ascending from the lowest needle position.

When the endless hook 21 ascends while the left needle thread 8 stays at the arresting portion 12*aa*, as shown in FIG. 7, the needle thread 8 between the thread hole 15 and arresting portion 12*aa* is took up in a deflected state in the endless hook 21, and the route length becomes longer due to the deflected portion of the endless hook 21 as compared with a straight route indicated by the single dot chain line running between the thread hole 15 and arresting portion 12*aa*. As a result, the thread looseness is absorbed. Stopping of the left needle thread at the arresting portion 12*aa* continues until the needle bar 3 ascends from the lowest position and the looper 7 picks up the needle thread loops 8L. Later, as shown in FIG. 3, the left needle thread is guided and slides along the cam face 12*a*.

According to the preferred embodiment, until the looper 7 picks up the needle thread loops 8L, as mentioned above, the left needle thread 8 remains at the arresting portion 12*aa*, and the cam face 12*a* does not perform cam action on the left needle thread 8 in this period, so that the length of the cam face can be shortened, and thereby resulting in the rise 1 shown in FIG. 6 to also be smaller.

The scope of the present invention is as set forth in the appended claims. Although the present invention has been described in terms of the preferred embodiment thereof, it is obvious to a person skilled in the art that various alterations and modifications are possible without departing from the scope of the claims.

What is claimed is:

1. A regulating device for handling a needle thread in a multi-needle double chain stitch sewing machine which handles a needle thread from a tension device to needles to loosen thread and to absorbed looseness of thread, said needle thread being arranged in plural sets corresponding to needles, said device comprising:

a thread taking-up tool attached to a needle bar moving up and down, said thread taking-up tool having a plurality of thread holes provided at the leading end thereof;

a thread handling body attached to the front side of a sewing machine head near the thread taking-up tool, said thread handling body having a cam face extending in the vertical direction;

wherein said needles are arranged in a lateral direction, and the thread taking-up tool is provided with thread hooking means for engaging with the needle thread supplied to the needle located at the remotest end of the laterally arranged needles where the largest needle thread loop is formed, and wherein a looper picks up needle thread loops as the needles ascend from their lowest position, between said thread holes of the thread taking-up tool and the cam face of the thread handling body, so as to handle other needle thread with the remotest end needle thread remaining at the curved lower end of the cam face.

2. The regulating device for handling a needle thread in a multi-needle double chain stitch sewing machine as claimed in claim 1, wherein the thread taking-up tool is provided in the needle bar sticking out from an obliquely drawn back position in the lower part of the sewing machine head.

3. The regulating device for handling a needle thread in a multi-needle double chain stitch sewing machine as claimed in claim 2, wherein one said cam face is formed on the thread handling body, and a plurality of needle threads are engaged with the same said cam face of the thread handling body.

4. The regulating device for handling a needle thread in a multi-needle double chain stitch sewing machine as claimed in claim 1, wherein one said cam face is formed on the thread handling body, and a plurality of needle threads are engaged with the same said cam face of the thread handling body.

5. A regulating device for handling a needle thread in a multi-needle double chain stitch sewing machine which handles a needle thread from a tension device to loosen thread and absorb looseness of thread, said needle thread being arranged in plural sets corresponding to needles, said device comprising:

a thread taking-up tool attached to a needle bar moving up and down, said thread taking-up tool having a plurality of thread holes provided at the leading end thereof;

a thread handling body attached to the front side of a sewing machine head near the thread taking-up tool, said thread handling body having a cam face extending in the vertical direction;

wherein the thread taking-up tool is provided in the needle bar sticking out from an obliquely drawn back position in the lower part of the sewing machine head, and wherein said thread holes of the thread taking-up spool are arranged in the lateral direction.

6. The regulating device for handling a needle thread in a multi-needle double chain stitch sewing machine as claimed in claim 5, wherein one said cam face is formed on the thread handling body, and a plurality of needle threads are engaged with the same said cam face of the thread handling body.

* * * * *